US008777365B2

(12) United States Patent
Noguera et al.

(10) Patent No.: US 8,777,365 B2
(45) Date of Patent: Jul. 15, 2014

(54) DEVICE FOR MOUNTING PRINTING HEADS

(75) Inventors: Remi Noguera, Limoges (FR); Cédric Coquet, Limoges (FR)

(73) Assignee: Ceradrop, Limoges (FR)

( * ) Notice: Subject to any disclaimer, the term of this patent is extended or adjusted under 35 U.S.C. 154(b) by 348 days.

(21) Appl. No.: 12/918,520

(22) PCT Filed: Feb. 17, 2009

(86) PCT No.: PCT/FR2009/000175

§ 371 (c)(1),
(2), (4) Date: Nov. 12, 2010

(87) PCT Pub. No.: WO2009/115681

PCT Pub. Date: Sep. 24, 2009

(65) Prior Publication Data

US 2011/0050802 A1 Mar. 3, 2011

(30) Foreign Application Priority Data

Feb. 22, 2008 (FR) ..... 08 51149

(51) Int. Cl.
*B41J 2/165* (2006.01)

(52) U.S. Cl.
USPC ..... 347/19

(58) Field of Classification Search
None
See application file for complete search history.

(56) References Cited

U.S. PATENT DOCUMENTS

| | | | | |
|---|---|---|---|---|
| 2001/0024227 | A1* | 9/2001 | Sekiya | 347/101 |
| 2005/0156963 | A1 | 7/2005 | Song et al. | 347/9 |
| 2006/0092199 | A1* | 5/2006 | White et al. | 347/9 |
| 2006/0227191 | A1* | 10/2006 | Williams et al. | 347/88 |
| 2007/0285652 | A1* | 12/2007 | Nielsen et al. | 356/237.2 |

FOREIGN PATENT DOCUMENTS

| | | | |
|---|---|---|---|
| EP | 0832752 A2 | 4/1998 | B41J 2/21 |

OTHER PUBLICATIONS

International PCT Written Opinion with Search Report, PCT/FR2009/000175, 7 pages, Oct. 23, 2009.

* cited by examiner

*Primary Examiner* — Alejandro Valencia
(74) *Attorney, Agent, or Firm* — King & Spalding L.L.P.

(57) ABSTRACT

The invention relates to a device for mounting printing heads for depositing fluids on a printing surface. The invention more particularly relates to a printing head mounting for improving the deposition precision and properties for a plurality of fluids. In order to do so, the present invention provides a printing head mounting having a geometric revolution axis about which are provided at least two means for maintaining printing heads. To this end, the invention provides a printing head holder that comprises at least two means (4) for maintaining printing heads (6) as well as anchoring means (10) for an observation module (12), characterized in that it comprises a geometric revolution axis (1) about which are provided the means (4) for maintaining the printing heads (6).

11 Claims, 4 Drawing Sheets

DEVICE FOR MOUNTING PRINTING HEADS

CROSS-REFERENCE TO RELATED APPLICATIONS

This application is a U.S. National Stage Application of International Application No. PCT/FR2009/000175 filed Feb. 17, 2009, which designates the United States of America, and claims priority to French Application No. 0851149 filed Feb. 22, 2008, the contents of which are hereby incorporated by reference in their entirety.

TECHNICAL FIELD OF THE INVENTION

The invention relates to a device for mounting printing heads for the successive deposition of a plurality of fluids on a printing surface.

The present invention relates to the technical field of fluid-printing devices and more particularly the sector of microfabrication of bidimensional or three-dimensional mono-material or multi-material components by ink jet printing.

BACKGROUND

It has been known by the state of the art various ink printing devices using several printing heads each containing several ejection nozzles. These nozzles may be arranged on one line and be spaced apart at a substantially constant distance. The use of the multi-nozzle printing heads allows to effectively increase the printing surface in one single passage, thus improving the printing rate. Meanwhile, in this case, the distance between the ejection nozzles conditions the lateral printing resolution, i.e., the distance between two points, in the direction perpendicular to the travelling direction of the printing heads.

However, it is essential to be able to make this lateral resolution vary, while maintaining it constant from one nozzle to the next on one same printing head. In fact, the quality of a deposit achieved by ink jet printing partially depends on the chemical-physical properties of the ejected fluid. The lateral resolution should thus be able to vary from one printing head to another depending on the fluid it contains. Moreover, for one same printing head containing a specific fluid, and for printing several layers, it is usually necessary to modify the properties of said layers by modifying the distance between two adjacent lateral deposits from one layer to another.

It is thus advantageous to be able to rapidly modify the lateral printing resolution with respect to the travelling direction while producing.

It has been known from the state of the art several solutions to reduce the lateral resolution.

The first consists in tilting each printing head with respect to the producing direction so as to reduce the distance between two printed points in the direction perpendicular to the producing direction. Meanwhile, an angle is usually fixed mechanically, and if need be modified manually for each printing head. Yet, within the framework of industrial manufacturing when one wishes to deposit one same fluid but in different conditions depending on the layer to print, it is necessary to be able to modify the angle of the head rapidly and precisely during use, which proves to be impossible if a manual intervention is necessary.

An alternative solution consists in placing several printing head behind each other by shifting them with respect to one another so as to divide the lateral resolution by the number of heads present. The main issue of this solution is that, to obtain a constant lateral resolution, the resolution possibilities can only be sub-multiples of the distance between the nozzles.

Furthermore, once these printing heads fixed with respect to each other, it becomes impossible to print points with a constant lateral resolution on the entire printing width if the user makes the orientation angle of this head group vary according to the travelling direction without modifying the relative positioning of the printing heads with respect to one another.

The object of the present invention is to compensate the drawbacks and limitations of the aforementioned state of the art. In this regard, the invention relates to a printing head holder making it possible to improve the precision and the properties of deposits of a plurality of fluids.

SUMMARY OF THE INVENTION

For this, the present invention puts forward a printing head holder exhibiting a geometric revolution axis around which are arranged at least two means for maintaining the printing heads.

In this regard, the object of the invention is a printing head holder comprising at least two means for maintaining printing heads as well as anchoring means for an observation module, comprising a geometric revolution axis around which are arranged the means for maintaining the printing heads.

Arranging at least two means for maintaining the printing heads around the geometric revolution axis of the head holder allows to adjust the lateral resolution of each printing head according to the fluids to deposit as well as the deposit properties to be obtained. Thus, it is possible to deposit several different inks during an operation, without intervention.

According to specific embodiments:

- the optical axis of the observation module is substantially merged with the geometric revolution axis of the printing head holder. Integrating an observation module which remains fixed with respect to the rotation of the printing heads enables to maintain an excellent repositioning precision and thus, whatever the angle applied to the said printing heads. Furthermore, the observation of the printing zone makes it possible to achieve the acquisition of images from the deposits carried out, but also to serve as a specific point of the substrate to reposition itself. This arrangement also aims to maintain a constant distance between the nozzles of each printing head and the optical axis of the observation module, whatever the angle by the printing heads, with respect to the geometric revolution axis;
- the means for maintaining the printing heads exhibit a degree of freedom of rotation with respect to the anchoring means of the observation module. The head holder may enter in rotation around the geometric revolution axis without driving the observation module and thus disturbing the positioning of this reference that constitutes the sighting axis.
- the head holder comprises a positioning bearing that makes it possible to maintain the printing heads at a specific height for which the ejection nozzles are positioned slightly below a lower protection member of the head holder. The positioning bearing makes it possible to maintain the printing heads according to a plan parallel to the substrate while making it possible to position the ejection nozzles slightly below the lower portion of the printing head holder so as to facilitate the cleaning of the ejection nozzles;

the maintaining means exhibit a thermal sealing member in order to reduce the contact surfaces and thus the thermal transfers between the head holder and the printing heads;

the anchoring means of the observation module comprise high and low fixing members located substantially at the two ends of the anchoring means;

the anchoring means of the observation module further exhibit an adjusting system of the direction of the optical axis observation module. Thus the adjustment of the direction of the optical axis of the observation module is improved making observation is more precise;

the holding means of the printing heads comprise removeable interface pieces specific to the printing head used. The interface pieces between the maintaining means and the printing heads are adjustable and thus allow for integrating printing heads exhibiting different dimensions. Furthermore, they ensure a repeatable and automatic precise positioning, of the printing heads;

the head holder comprises three maintaining means exhibiting a median plan that forms a 120-degree angle with the two median plans of the maintaining means which are adjacent to it.

The invention also relates to a fluid-printing device comprising a printing head holder according to the invention.

BRIEF DESCRIPTION OF THE FIGURES

Other characteristics and advantages of the invention will appear upon reading the following detailed embodiment, with reference to the accompanying drawings which respectively represent.

DETAILED DESCRIPTION OF AN EMBODIMENT

Figure 1:
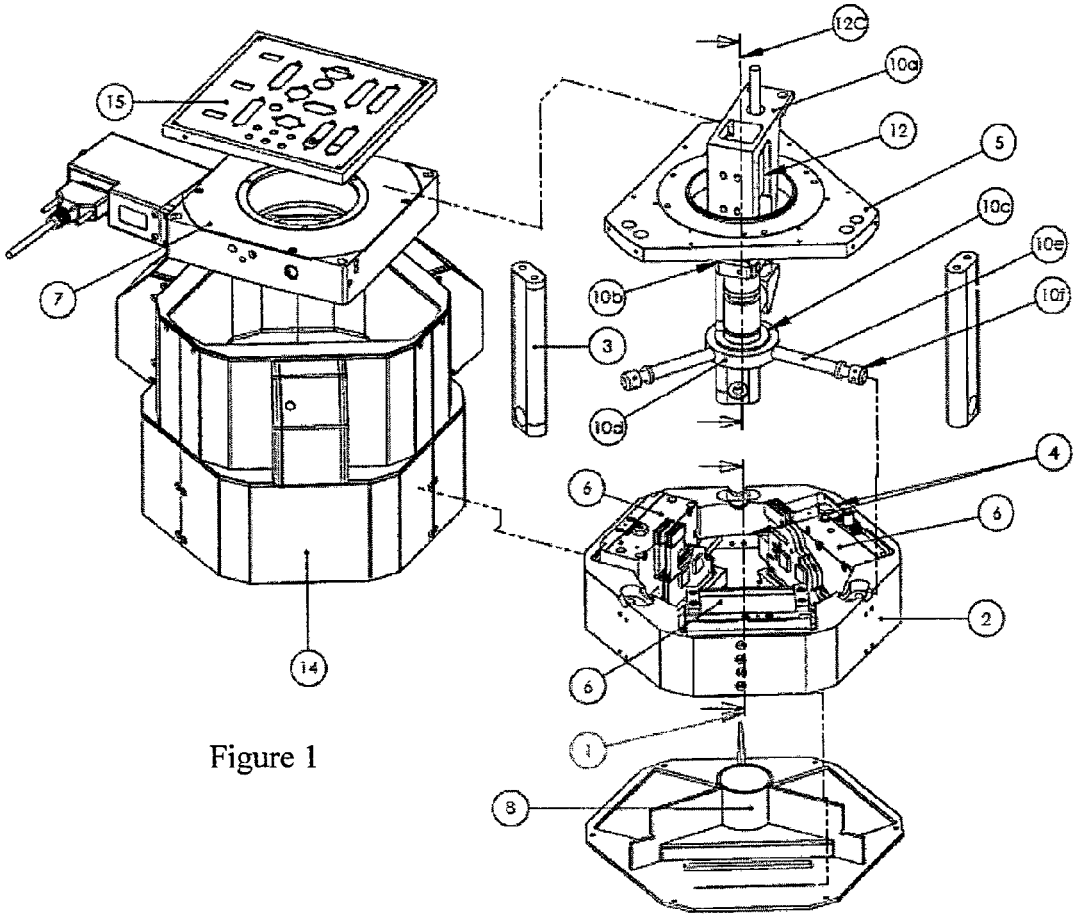
FIG. 1, an exploded view of an embodiment of the printing head holder according to the invention.

FIG. 1 illustrates an embodiment of a printing head holder able to be mounted on a positioning portal (not shown) such as to print drops of fluids on a preferably horizontal printing surface.

It is furthermore provided with a rotary plate 7 making it possible to drive the printing head holder in rotation according to a geometric revolution axis 1, preferably perpendicularly to the printing surface.

The printing head holder comprises a basic member 2 exhibiting means for maintaining 4 printing heads 6, a lower protection member 8 and anchoring means 10 of an observation module 12. These pieces are protected by a cell 14 which, during normal operation, does not allow the user access inside the head holder and protects the printing heads 6 and their control cards from any outside aggression.

Moreover, a printer attachment 15 advantageously allows to integrate the plugging of power cables. Preferably, hydraulic, pneumatic or electric pipes are partitioned within this printer attachment 15 in distinct spaces so as to avoid misuse. The printer attachment 15 further allows to facilitate the operation of changing the supply cables in as far as this change does not imply a direct intervention on the printing heads 6.

It is worth noting that in the embodiment in FIG. 1, the observation module 12 is fixed with respect to the positioning portal whereas the basic member 2 comprising means for maintaining 4 the printing heads 6 can enter in rotation by means of the rotary plate. Thus, the positioning of the head holder allows, during each movement and for each printing head, to generate an angle of inclination between the direction of nozzle lines and the travelling direction of the positioning portal. Furthermore, the observation module remains fixed with respect to the printing heads and the distance between this observation module and each ejection nozzle of each printing head remain constant during the rotation of the holder member.

Meanwhile, according to an alternative embodiment, it would also be possible to link the observation module 12 with the basic member 2 so that they are fixed with respect to each other.

Figure 2:
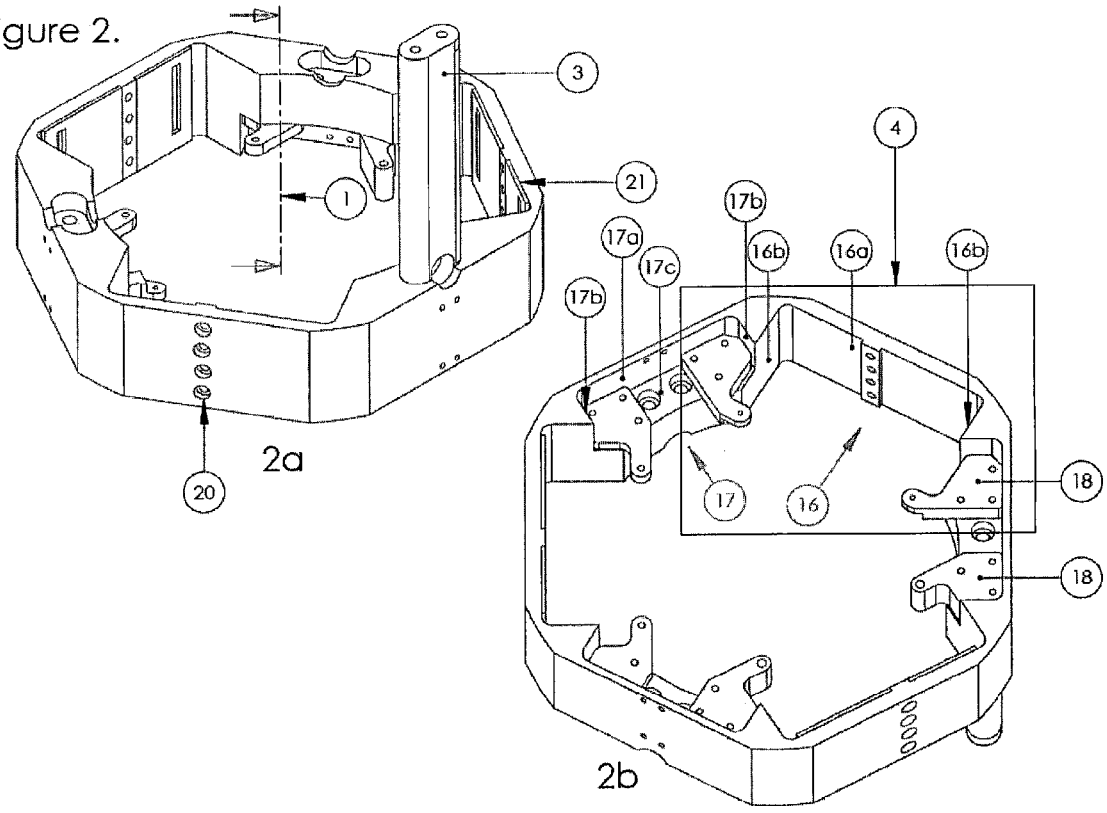
FIGS. 2*a* and 2*b*, two top and bottom perspective views of a basic member comprising the head holder of FIG. 1.

The basic member 2 represented on FIG. 2 exhibits a hexagonal section, preferably regular, hollow in its centre so as to define an observation space for the observation module 12. Alternatively, the basic member 2 may be of circular, triangular, pentagonal or of any other polygon shape.

Maintaining means 4 of the printing heads 6 are positioned on three of the six sections of the basic member 2, preferably equidistant from the geometric revolution axis 1.

The maintaining means 4 are shaped by a pocket 16 that is delimited by a peripheral wall 16*a*, two lateral walls 16*b* as well as by a recess delimited by a peripheral wall 17*a*, two lateral walls 17*b* and a low wall 17*c*. Interface pieces 18 that make it possible to position the printing heads 6 with respect to the basic member are fixed in these recesses 17. According to a non limitative embodiment represented on FIG. 2, the interface pieces 18 are constituted of two fins positioned in the recesses 17 located on either side of the pockets 16 which form the maintaining means 4.

These interface pieces 18 form the main support of each maintaining means 4 and are directly mounted on a nozzle plate of printing head 6 thus achieving one portion of the link between the basic member 2 and the printing heads 6. Advantageously, these interface pieces 18 form a horizontal positioning bearing making it possible to ensure the parallel positioning of the ejection nozzles with respect to the printing surface and to maintain the printing heads 6 at a specific height for which these ejection nozzles are positioned slightly below the lower protection 8. Thus, the ejection nozzles of the printing heads 6 may be easily cleaned, for example by plunging them in a sonicator.

It is worth noting that the interface pieces 18 are removeable and specific to each type of printing head 6 and are paired for greater precision. Furthermore, the entire phase of positioning the printing heads 6 in the maintaining means 4 may be achieved automatically. The precision obtained for the positioning of the printing heads 6 thus enables reproducibility of their positioning with respect to the geometric revolution axis of the head holder.

The peripheral wall 16*a* of the pocket 16 comprises several fixing members 20 positioned at various heights to fix the tanks of the different types of printing heads 6. The peripheral wall 16*a* advantageously exhibits a sealing member 21, such as a piece of plastic, allowing it to prevent the exchange of heat between the basic member 2 and the printing heads 6. Alternatively, the sealing member 21 may be achieved by reducing the contact surface by forming shoulders on the peripheral wall 16*a*.

Figure 3:
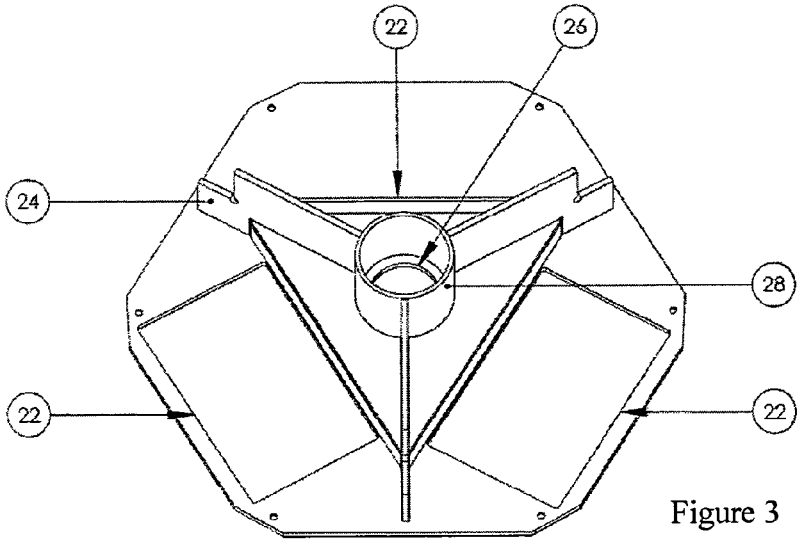
FIG. 3 a perspective view of a lower protection member comprising the head holder of FIG. 1.

The lower protection member 8 is fixed to the lower surface of the basic member 2 represented on FIG. 3. According to this embodiment, this lower protection member 8 is a thin plate comprising three openings 22 to make it possible for the printing heads 6 to deposit the drops of fluid on the printing surface.

The lower protection member 8 also comprises three vertical partitioning fins 24 arranged radially between the openings 22 such as to protect the printing heads 6 with respect to one another to avoid any type of pollution from a fluid with respect to another.

Furthermore, a coaxial observation opening 26 with the geometric revolution axis 1 of the head holder is achieved on this lower protection member 8. The observation opening 26 has a protective cover 28 thereon wherein slides the end of the lens (described hereinafter) of the observation module 12, thus protecting it from outside aggression and ink projections. Advantageously, this observation opening 26 exhibits a relatively low diameter for limiting the penetration of impurities in the observation module 12.

Figure 4:
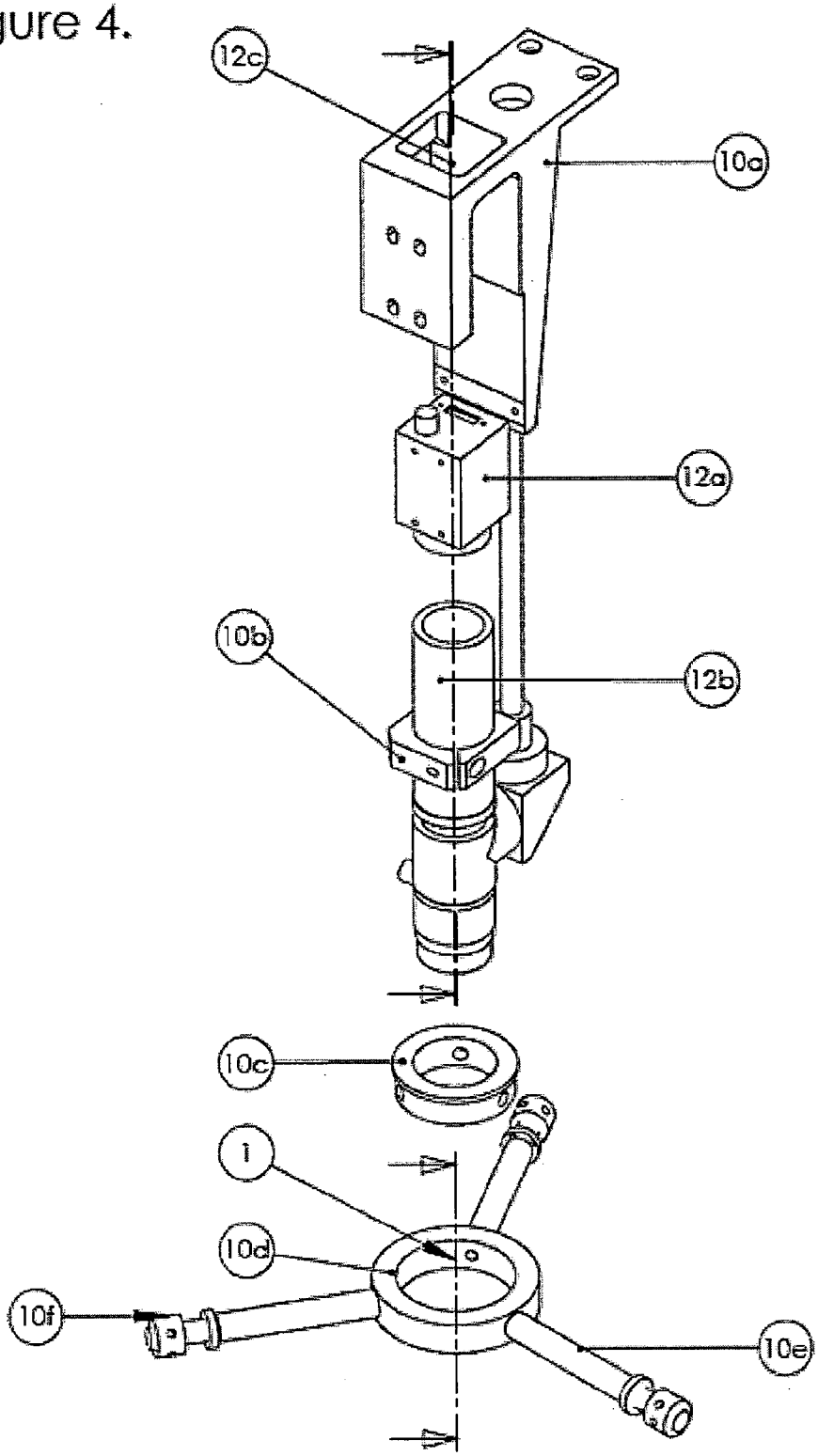
FIG. 4, an exploded view of anchoring means of the observation module comprising the head holder of FIG. 1.
Figure 5:
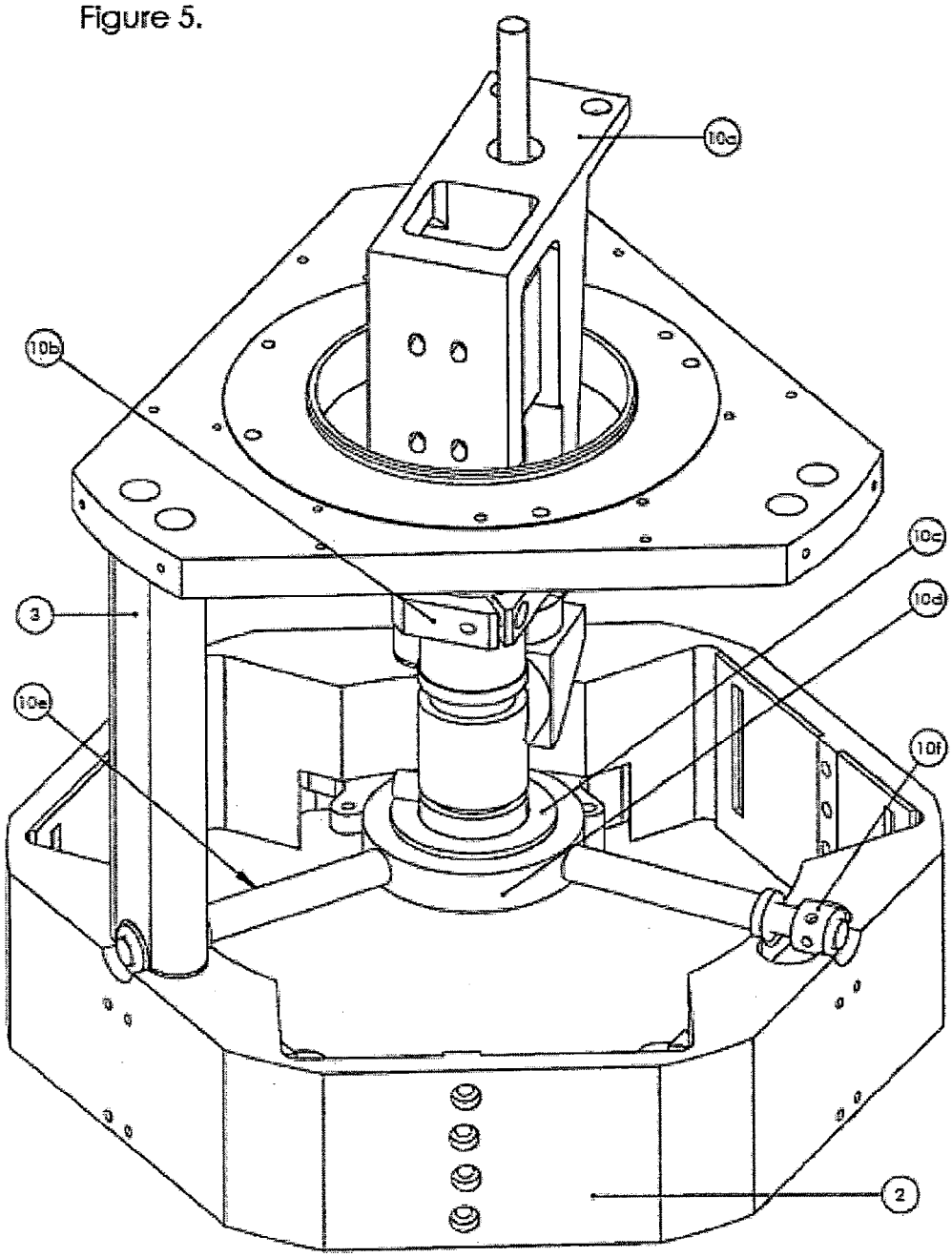
FIG. 5, a perspective view of the anchoring means 10 of the observation module (12) fixed to the basic member 2 of the head holder of FIG. 1.

An embodiment of anchoring means 10 of the observation module 12 is described below with reference to FIG. 4. These anchoring means 10 are intended to position in a stable manner the optical axis 12*c* of the observation module 12 which coincides with the geometric revolution axis 1. Thus, the position of each ejection nozzle may be precisely determined with respect to the geometric revolution axis.

The observation module 12 is preferably, constituted of a camera 12*a* and a lens 12*b*. The camera 12*a* is mounted on a fixing piece 10*a*, itself fixed on the positioning portal. This fixing piece 10*a* makes it possible to curb the high portion of the observation module 12. Moreover, a fixing piece 10*a* is also linked to the lens 12*b* of the observation module 12, such as to rigidify the link between the camera 12*a* and the lens 12*b*.

The lower portion of the observation module 12 also needs to be rigidified to avoid all flexion phenomenon during travelling. The anchoring means 10 of the observation module 12 therefore comprise a bronze ferrule 10*c* tightly mounted on the lower portion of the lens 12*b*.

This bronze ferrule 10*c* interacts with an aluminium ring 10*d* to form a pivot joint. The ring 10*d* is further linked to threaded members 10*f* by means of three positioning arms 10*e*.

The three positioning arms 10*e* are positioned within the maintaining means 3 and they are maintained in position by threaded members 10*f*. The maintaining members 3 are at the same time secured to the basic member 2 and the adaptation members 5 and ensure the rigidity of the printing head holder.

This adaptation member 5 advantageously makes it possible to secure this assembly to the rotary plate 7. The adaptation member 5, represented on FIG. 1, exhibits a triangular section, preferably regular, hollow in its centre so as to define a space for the observation module 12. Alternatively, the adaptation member 5 may be of circular, hexagonal, pentagonal or of any other polygon shape.

The positioning of the three positioning arms 10*e* is carried out via a sliding pivot joint so as to be able to adjust the position of the axis of the observation module 12*c* substantially on that of the geometric revolution axis 1 by action the threaded members 10*f*. Thus, the optical axis 12*c* of the observation module 12 is positioned precisely with respect to the printing heads 6 and these may enter into rotation around the geometric revolution axis 1 of the basic member 2, without the observation module 12 also entering into movement.

It is worth noting that the anchoring means 10 of the observation module 12 are advantageously arranged at the two ends of the observation module so as to precisely monitor the direction of the optical axis 12*c* of the observation module 12. Advantageously, the positioning arms 10*e* comprise an adjusting system to modify if need be the direction of the optical axis 12*c* of the observation module 12.

The invention is in no way limited to the embodiments described and represented. The skilled person is capable of achieving various alternative embodiments described below within the framework of the invention. Particularly, the printing head holder may exhibit as many maintaining means 4 of printing heads 6 as necessary. Furthermore, the printing heads may be placed at different distances from the geometric revolution axis, while remaining around this geometric revolution axis and thus within the framework of the patent application.

The invention claimed is:

1. A printing head holder comprising:

at least two means for maintaining printing heads; and anchoring means of an observation module which is arranged generally between the at least two means for maintaining printing heads and which has an optical axis;

wherein the at least two means for maintaining printing heads are arranged around a geometric revolution axis of the printing head holder and are configured to rotate around the observation module arranged generally between the at least two means for maintaining printing heads; and wherein the optical axis of the observation module is substantially coaxial with the geometric revolution axis of the printing head holder.

2. The printing head holder according to claim 1, wherein the means for maintaining the printing heads exhibit a rotation freedom degree with respect to the anchoring means of the observation module.

3. The printing head holder according to claim 1, comprising a positioning stopper hold the printing heads at a specific height for which the ejection nozzles are positioned slightly below a lower protection member of the head holder.

4. The printing head holder according to claim 1, wherein the maintaining means exhibit a thermal sealing member.

5. The printing head holder according to claim 1, wherein the anchoring means of the observation module comprises high and low fixing members substantially located at both ends of the anchoring means.

6. The head holder according to claim 1, wherein the anchoring means of the observation module further comprise a system for adjusting the direction of the optical axis of the observation module.

7. The printing head holder according to claim 1, wherein the means for maintaining the printing heads comprise removable interface pieces, specific to the used printing head.

8. The printing head holder according to claim 1, comprising three means for maintaining printing heads, the three means being arranged at 120-degree angles with respect to each other.

9. Fluid printing device comprising a printing head holder comprising:

at least two means for maintaining printing heads; and anchoring means of an observation module which is arranged generally between the at least two means for maintaining printing heads and which has an optical axis;

wherein the at least two means for maintaining printing heads are arranged around a geometric revolution axis of the printing head holder and are configured to rotate around the observation module arranged generally between the at least two means for maintaining printing heads; and wherein the optical axis of the observation module is substantially coaxial with the geometric revolution axis of the printing head holder.

10. A printing head holder comprising:

a rotatable support member comprising at least two means print head maintaining features configured to receive and maintain at least two removable printing heads; and wherein the at least two print head maintaining features are arranged at different locations around a geometric revolution axis of the printing head holder; and an anchoring device configured to anchor an observation module generally between the at least two print head maintaining features;

wherein the rotatable support member is rotatable relative to the anchoring device such that rotation of the support member relative to the anchoring device causes printing heads maintained in the at least two print head maintaining features to rotate around the observation module.

11. The printing head holder according to claim 10, wherein the rotatable support member comprises three print head maintaining features arranged at 120-degree angles from each other.

* * * * *